US006467777B2

(12) United States Patent
Teyhen

(10) Patent No.: US 6,467,777 B2
(45) Date of Patent: Oct. 22, 2002

(54) IN-LINE ROLLER SKATES WITH POWER ASSIST ROLLER

(76) Inventor: J. Gary Teyhen, 5 Winchester Ct., Bordentown, NJ (US) 08505

( * ) Notice: Subject to any disclaimer, the term of this patent is extended or adjusted under 35 U.S.C. 154(b) by 0 days.

(21) Appl. No.: 09/825,197

(22) Filed: Apr. 3, 2001

(65) Prior Publication Data

US 2002/0113383 A1 Aug. 22, 2002

Related U.S. Application Data

(60) Provisional application No. 60/270,342, filed on Feb. 21, 2001.

(51) Int. Cl.[7] ..... A63C 1/00; A63C 17/02; A63C 17/14

(52) U.S. Cl. ..... 280/11.115; 280/11.221; 280/11.215

(58) Field of Search ..... 280/11.15, 11.23, 280/11.24, 11.25, 11.27, 11.28, 11.221, 841, 293, 301, 298, 288.4, 11.115, 11.215, 11.201

(56) References Cited

U.S. PATENT DOCUMENTS 2,449,871 A * 9/1948 Bohler ..... 280/11.115
2,450,979 A * 10/1948 Moller ..... 280/303
2,712,947 A * 7/1955 Pawsat et al. ..... 280/293
4,154,452 A * 5/1979 Newman ..... 280/293
4,272,091 A 6/1981 Reid, Jr. ..... 280/11.28
4,512,590 A 4/1985 Stenvall ..... 280/11.23
5,183,276 A 2/1993 Pratt ..... 280/11.22
5,192,088 A 3/1993 Yu ..... 280/11.22
5,704,620 A 1/1998 Oliemans et al. ..... 280/11.22
5,823,543 A 10/1998 Burns et al. ..... 280/11.22
5,908,196 A 6/1999 Weiss ..... 280/11.19
6,042,123 A 3/2000 Eck, Sr. ..... 280/11.19
6,070,885 A * 6/2000 Ferone ..... 280/11.19

* cited by examiner

*Primary Examiner*—Brian Johnson
*Assistant Examiner*—Gerald B. Klebe
(74) *Attorney, Agent, or Firm*—Mathews, Collins, Shepherd & McKay

(57) ABSTRACT

An in-line skate with power assistance has at least two rollers attached to a base, the at least two rollers aligned to form an in-line axis such that the at least two rollers travel along a surface in essentially a single travel line and a power roller aligned outward of the at least two rollers. A bias mechanism coupled between the power roller and the base, the bias mechanism is responsive to pressure on the power roller when contacting the surface to adjust position of the power roller relative to the base. The power roller is adjustable and resiliently mounted to be positioned above the skating surface when gliding. The power roller makes with contact the skating surface when pushing, the pressure on the power roller being varied by the bias mechanism.

22 Claims, 3 Drawing Sheets

IN-LINE ROLLER SKATES WITH POWER ASSIST ROLLER

CROSS REFERENCES TO RELATED APPLICATIONS

This application claims the benefit of U.S. Provisional application Ser. No. 60/270,342 filed on Feb. 21, 2001.

FIELD OF THE INVENTION

This invention relates to roller skates, and more particularly to roller skates having in-line rollers.

BACKGROUND OF THE INVENTION

In-line skates, also called roller blades, were initially developed for use by hockey players to train during the off season. In the early 1990's companies saw the growth potential of the in-line design and turned it into a billion dollar industry. In-line skating quickly became an international sport that can be enjoyed by all ages and people from all walks of life. Skating is a low impact sport that makes it an excellent aerobic exercise providing a strength-training tool, cardiovascular, fat and calorie burning workout.

In-line skating can be found everywhere, from streets and parks, boardwalks, industrial parking lots, outdoor running tracks, bicycle paths, indoor and outdoor running tracks. During the 1996 Olympic Games in-line skating was a exhibition sport.

A skater gets started by using a right push, glide, left push, glide sequence. When the skater's foot pushes off they should feel ankle press against the tongue of that skate. If the skater's knees are not adequately bent they will not be able to get enough power for a good push off.

The amount of power that an in-line skater can get during a push is related to the speed of the thrust, the angle and the surface area of the rollers making contact with the skating surface. Unfortunately, the surface area of the rollers making contact with the skating surface is also directly related to rolling resistance. Thus an inevitable trade off between increased power pushes and glide rolling resistance occurs.

Therefore there is a need for an in-line roller skate which offers reduces glide rolling resistance while providing increased power during push.

SUMMARY OF THE INVENTION

In one aspect, the present invention is an in-line roller skate having a flexible power roller, which provides no rolling resistance during gliding movement.

BRIEF DESCRIPTION OF THE DRAWINGS

A more complete understanding of the present invention may be obtained from consideration of the following description in conjunction with the drawings in which.

DETAILED DESCRIPTION OF VARIOUS ILLUSTRATIVE EMBODIMENTS

The present invention is an in-line skate with power assistance. At least two rollers attached to a base, the at least two rollers aligned to form an in-line axis such that the at least two rollers travel along a surface in essentially a single travel line and a power roller aligned outward of the at least two rollers. A bias mechanism coupled between the power roller and the base, the bias mechanism is responsive to pressure on the power roller when contacting the surface to adjust position of the power roller relative to the base. The power roller is held above the surface when gliding and the power roller makes contact the surface when pushing, the pressure on the power roller being varied by the bias mechanism.

Figure 1:
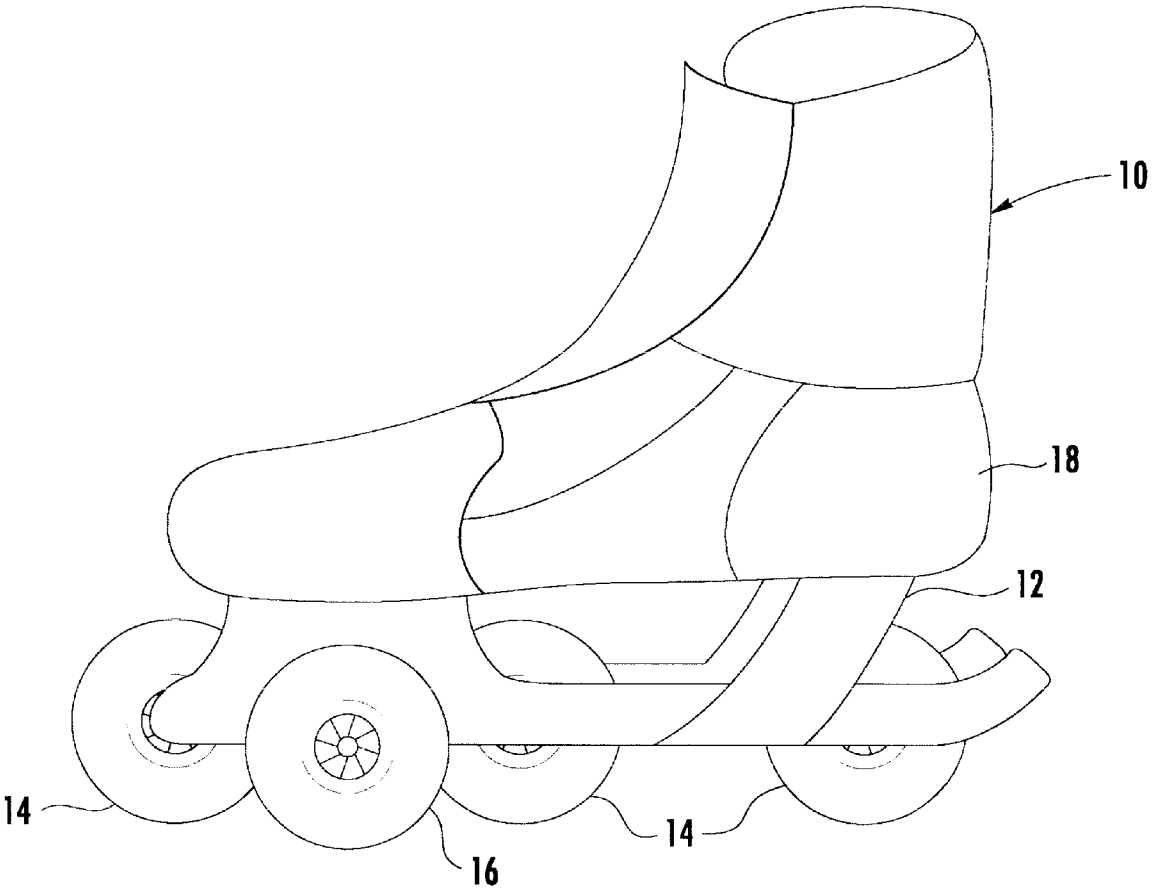
FIG. 1 is a perspective view of the in-line skate with power assist roller.

Referring to FIG. 1 there is shown a perspective view of an exemplary embodiment of the present invention in-line skate with power assist roller. The in-line skate with power assist roller 10 has a base structure 12, a series of in-line rollers 14, a power assist roller 16, and boot 18. The power assist roller 16 is resiliently mounted slightly higher than the series of in-line rollers 14 relative to a skating surface when the in-line skate with power assist roller 10 is operated in the glide position. The height of the power assist roller 16 relative to the series of in-line rollers 14 is adjustable to allow a user to select when the power assist roller 10 will make contact with the skating surface. In the push position, the power assist roller 16 makes contact with the skating surface, with contact pressure being varied by a bias mechanism (not shown in FIG. 1).

The amount of power that an in-line skater can get during a push is related to the speed of the thrust, the angle and the surface area of the rollers making contact with the skating surface. By having a different amount of surface area of the rollers making contact with the skating surface during the glide position and the push position, rolling resistance can be lower during a glide than a push. Thus the previously inevitable trade off between increased power pushes and reduced glide rolling resistance is overcome. This results in an in-line roller skate which offers reduces glide rolling resistance while providing increased power during push.

It is important to vary the height of the power assist roller 16 during the push position. If the power assist roller 16 is set at an essentially a fixed height, pressure being applied to the skating surface by the series of in-line rollers 14 during a push will be reduced, while the pressure being applied to the skating surface by the power assist roller 16 will be increased. The power assist roller 16 being resiliently mounted varies the height of the power assist roller 16 during the push position.

Figure 2B:
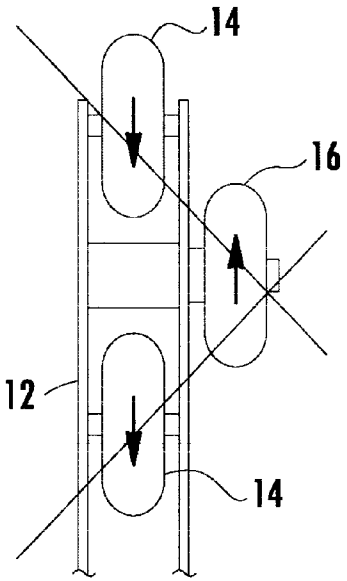
FIGS. 2*a* and 2*b* are a detail view of the alignment of the in-line and power assist rollers; and, FIGS. 3*a*, 3*b* and 3*c* are detail views of the bias mechanism.
Figure 2A:
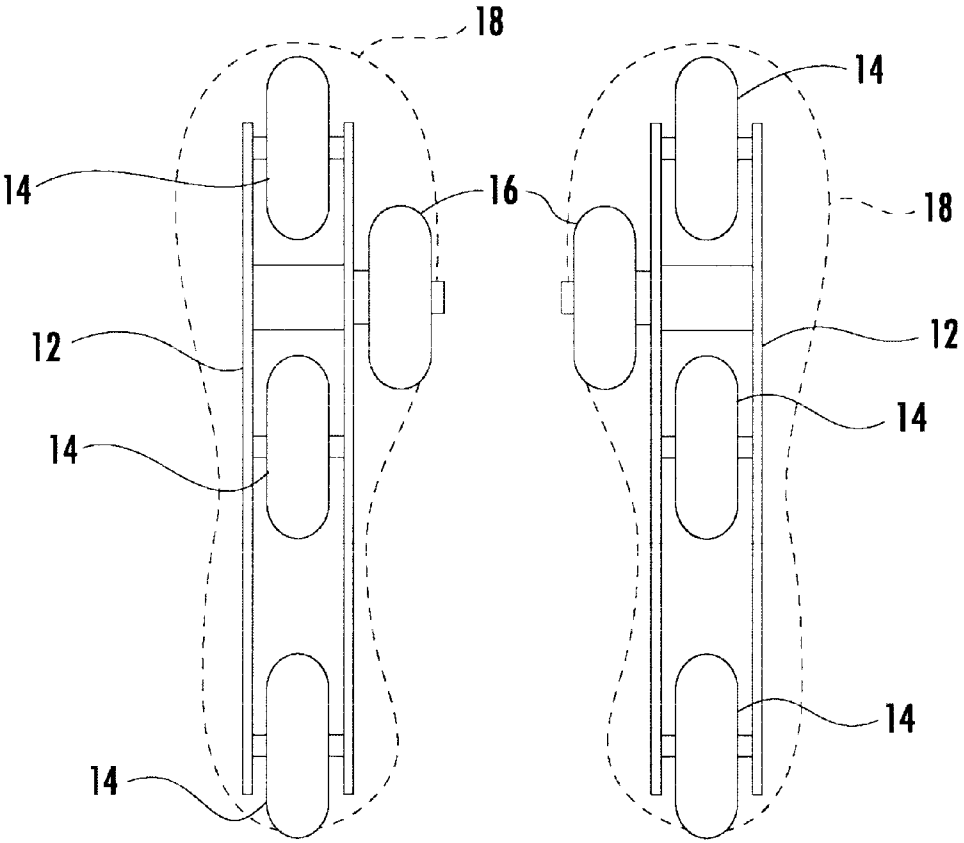

Referring to FIG. 2 there is shown the relative alignment of the series of in-line rollers 14 and the power assist roller 16. The series of in-line rollers 14 make contact with the skating surface during a glide. Referring to FIG. 2*b*, it is shown that during a push, contact is shifted primarily to the front two rollers of the series of in-line rollers 14 and the power assist roller 16. The natural movement of pushing, when taking off, results in the front three wheels rotating in the direction shown by the arrows. This will allow the wheels to lock up and grip the skating surface for pushing off.

Figure 3A:
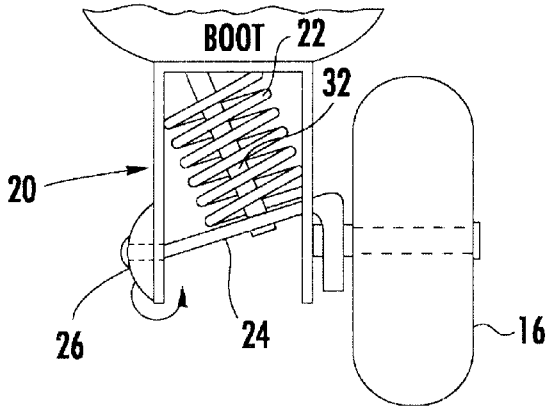
Figure 3B:
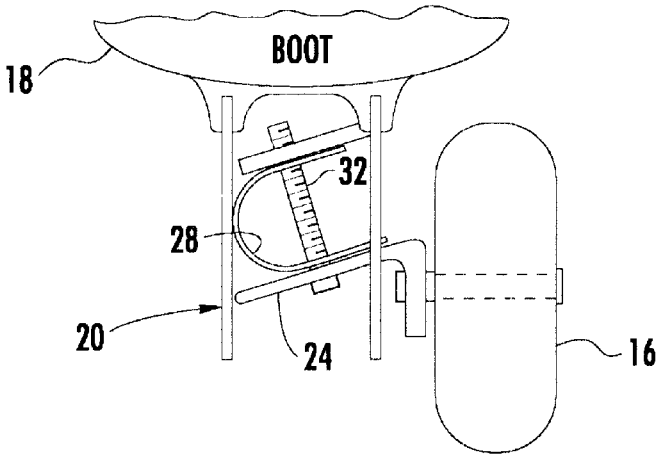
Figure 3C:
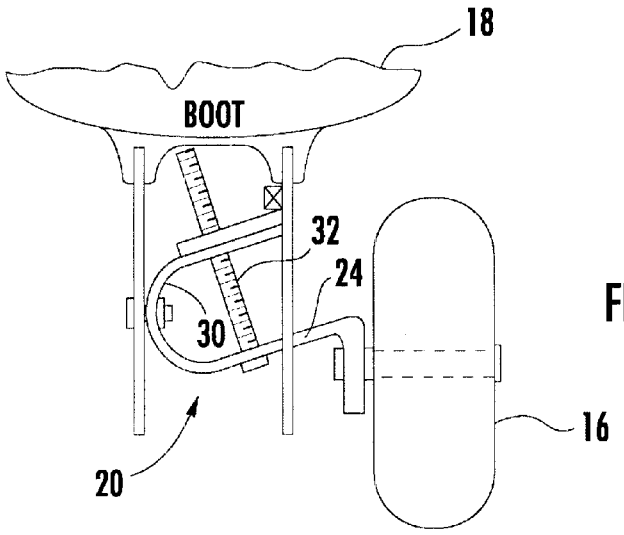

Referring to FIGS. 3*a*, 3*b* and 3*c* there are shown various representative embodiments of the bias mechanism 20, which is coupled to the power assist roller 16. FIG. 3*a* shows a bias mechanism 20, which utilizes a coil spring 22. Various types of coil springs can be used, including a coil spring having a variable-spring-constant (also known as a progressive rate spring by those skilled in the art) as well as a standard coil spring. The power assist roller 16 is coupled to a power assist axel 24. The power assist axel 24 is coupled to a pivot plate 24. The pivot plate 24 moves relative to a pivot point 26, wherein the coil spring 22 offers increasing resistance directly corresponding to increasing movement of the pivot plate 24. Another embodiment of the bias mechanism 20 is shown in FIG. 3*b*. An adjustable leaf spring 28 provides the resistance to the pivot plate 24. Yet another embodiment of the bias mechanism 20 is shown in FIG. 3*c*. An adjustable leaf spring 28 is integral with the pivot plate 24.

The offset height of the power assist roller 16 may be adjusted. The resistance applied by the bias mechanism 20 may be adjusted by turning the bolt 32 which pre-compresses the leaf spring 28 or the coil spring 22. Adjusting the pre-compression of the leaf spring 28 or the coil spring 22 will change the force of resistance necessary to compress the spring. This enables the present invention in-line roller skate having a flexible power roller to be adjusted for better performance relative to the particular weight and skating style of the use.

The power assist roller 16 and the corresponding bias mechanism 20 enable natural the natural movements of a user to be utilized where push off is increased without slipping because of the positive gripping of the three wheels, resulting in increased speed, which is complemented by reduced rolling resistance. Essentially the power assist roller 16 provides assistance when desired without interfering with natural skating motions or even fancy trick maneuvers.

In view of the foregoing description, numerous modifications and alternative embodiments of the invention will be apparent to those skilled in the art. The in-line skate with power assistance device may include a boot (shoe, boot or other suitable footwear) integral to the skate or may have a base adapted to be removably attached to a boot. The attachment of the in-line skate with power assist device to the boot may be done by clamping onto the boot, utilizing suitable fasteners, known to those skilled in the art, or encapsulating the boot in an outer casement or sleeve. Furthermore, in an optional embodiment, the power assist device may be retrofitted to a standard in-line skate, during manufacturing as an option, or installed in the field on a standard in-line skate. The retrofitted attachment of the power assist device to the in-line skate may be done by any suitable fastener or coupling mechanism, including bolts, clamps, screws, welding, adhesive and other methods known to those skilled in the art. Accordingly, this description is to be construed as illustrative only and is for the purpose of teaching those skilled in the art the best mode of carrying out the invention. Details of the structure may be varied substantially without departing from the spirit of the invention, and the exclusive use of all modifications, which come within the scope of the appended claim, is reserved.

I claim:

1. An in-line skate with power assistance comprising:

at least two rollers attached to a base, the at least two rollers aligned such that the at least two rollers travel along a surface in essentially a single travel line;

a power roller offset from the at least two rollers such that the power roller travels along the surface in different travel line; and a bias mechanism coupled between the power roller and the base, the bias mechanism is responsive to pressure on the power roller when contacting the surface to adjust position of the power roller relative to the base;

wherein the power roller is held above the surface when gliding and the power roller makes contact with the surface providing additional surface area contact when pushing over a range of angles relative to the surface.

2. The in-line skate as recited in claim 1 wherein the responsiveness to pressure of the power roller is adjustable.

3. The in-line skate as recited in claim 1 wherein the bias mechanism comprises a spring.

4. The in-line skate as recited in claim 1 wherein the bias mechanism comprises a leaf spring.

5. The in-line skate as recited in claim 1 wherein the bias mechanism comprises a coil spring.

6. The in-line skate as recited in claim 5 wherein the coil spring has a variable spring constant.

7. The in-line skate as recited in claim 1 wherein the height that the power roller is held above the surface when gliding is adjustable.

8. The in-line skate as recited in claim 1 further comprising a boot coupled to the base.

9. The in-line skate as recited in claim 1 wherein the at least two rollers comprise three rollers attached to a base, the three rollers aligned such that the three rollers travel along a surface in essentially a single travel line.

10. An in-line skate with power assistance for use on a skating surface, the in-line skate comprising:

a boot attached to a base;

three rollers attached to the base, the three rollers aligned such that the three rollers travel along the skating surface in essentially a single travel line;

at least one power roller offset from the three rollers such that the at least one power roller travels along the skating surface in different travel line; and a bias mechanism coupled between the power roller and the base, the bias mechanism is responsive to varying pressure on the power roller when contacting the surface to adjust position of the power roller relative to the base;

wherein the power roller is held above the surface when gliding and the power roller makes contact with the surface providing additional surface area contact when pushing over a range of angles relative to the surface.

11. The in-line skate as recited in claim 10 wherein the varying responsiveness to pressure of the at least one power roller is adjustable.

12. The in-line skate as recited in claim 10 wherein the bias mechanism comprises a spring.

13. The in-line skate as recited in claim 10 wherein the bias mechanism comprises a leaf spring.

14. The in-line skate as recited in claim 10 wherein the bias mechanism comprises a coil spring.

15. The in-line skate as recited in claim 14 wherein the coil spring has a variable spring constant.

16. The in-line skate as recited in claim 10 wherein the height that the at least one power roller is held above the surface when gliding is adjustable.

17. A power assistance device for use with an in-line skate having a base with at least two rollers attached to the base, the at least two rollers aligned such that the at least two rollers travel along a surface in essentially a single travel line, the power assistance device comprising:

a power roller offset from the at least two rollers such that the power roller travels along the surface in different travel line, the power roller having a mechanism coupling the power roller to the base; and a spring bias mechanism coupled between the power roller and the base, the bias mechanism is responsive to varying pressure on the power roller when contacting the surface to adjust position of the power roller relative to the base;

wherein the power roller is held above the surface when gliding and the power roller makes contact with the surface providing additional surface area contact when pushing over a range of angles relative to the surface.

18. The power assistance device as recited in claim 17 wherein the responsiveness to pressure of the power roller is adjustable.

19. The power assistance device as recited in claim 17 wherein the spring bias mechanism comprises a leaf spring.

20. The power assistance device as recited in claim 17 wherein the spring bias mechanism comprises a coil spring.

21. The power assistance device as recited in claim 20 wherein the coil spring has a variable spring constant.

22. The power assistance device as recited in claim 17 wherein the height that the power roller is held above the surface when gliding is adjustable.

* * * * *